US005435766A

United States Patent [19]

Epstein

[11] Patent Number: 5,435,766

[45] Date of Patent: Jul. 25, 1995

[54] RESCUE DEVICE FOR SAILBOATS

[76] Inventor: David M. Epstein, 54 Turning Mill Rd., Lexington, Mass. 02173

[21] Appl. No.: 381,709

[22] Filed: Jan. 31, 1995

[51] Int. Cl.[6] ..... B63C 9/00

[52] U.S. Cl. ..... 441/80; 114/39.1

[58] Field of Search ..... 114/39.1, 102, 103, 114/365, 368, 376, 377; 441/80, 83, 84, 86, 88

[56] References Cited

U.S. PATENT DOCUMENTS

| | | |
|---|---|---|
| 4,313,236 | 2/1982 | Tupper et al. . |
| 4,599,073 | 7/1986 | Fryer et al. . |
| 4,678,446 | 7/1987 | Dahan . |
| 4,773,887 | 9/1988 | Steffanus . |

FOREIGN PATENT DOCUMENTS

| | | | |
|---|---|---|---|
| 1057703 | 3/1954 | France | 441/80 |
| 2736873 | 3/1979 | Germany | 441/80 |
| 2153336 | 8/1985 | United Kingdom | 441/80 |

*Primary Examiner*—Stephen Avila
*Attorney, Agent, or Firm*—Richard P. Crowley

[57] ABSTRACT

A sailboat with a device for retrieving from the water a person who has fallen overboard. The device consists of a crane mounted on strong, cylindrically-shaped metal tubing fitted over the shroud of the mainmast of the sailboat. The metal tubing consists of an upper tube and a lower tube, the upper tube having a smaller diameter than the lower tube and fitting inside, and has bushings at the top and bottom and also at the point where the upper tube is inserted into the lower tube. The crane consists of a crane arm that can be moved angularly outward and is controlled by a line secured to the metal tubing. A block and tackle with a T-bar rescue device extends from the crane arm. The T-bar rescue device is lowered or raised by the use of the block and tackle device and a hoisting rope, which rope can be drawn manually or by the use of a winch attached to the main mast.

13 Claims, 4 Drawing Sheets

RESCUE DEVICE FOR SAILBOATS

BACKGROUND OF THE INVENTION

There have been numerous techniques and devices suggested and used for the rescue or retrieval from the water of a sailboat crew member who has fallen overboard, or for rescuing other persons in the water. The procedures start with methods for bringing the boat back to the location of the victim. It is further advised that the boat be positioned to windward of the victim, so that the hull shields the victim from the full force and action of waves and wind.

There are a number of devices currently on the market for getting a retrieval line to the man in the water. Some devices call for heaving a floating buoy to the victim, the buoy attached to a floating line that is in turn attached to the vessel. In this manner, the victim can be pulled close to the boat. One product is described in the Fryer et al U.S. Pat. No. 4,599,073. This product consists of a flexible collar, filled with flotation material, which is designed to be slipped under the arms of the overboard victim. The collar is attached to a floating polypropylene retrieving line whose other end is attached to the boat.

One negative aspect of overboard rescue not yet satisfactorily resolved concerns the means for hoisting the victim from the water onto the boat. The problems encountered are numerous and serious: For one, the hoisting method must be capable of lifting a potential maximum weight of close to 200–300 pounds or more. The method must provide for a person of minimal strength to do this job - such as a diminutive crew member who must work on the pitching deck of the boat. Rescue must be quick to prevent the victim's exhaustion, and his/her possible drowning.

Additionally, the hoisting method must be designed such that the victim will not be smashed against the boat's hull while being lifted from the sea. Further, the lifting device must not place large forces upon the victim's body.

It is therefore desirable to provide a new and improved rescue device, particularly for use with a sailboat, and which device overcomes many of the problems associated with prior art methods and devices of retrieving and hoisting a person onto a sailboat from the water.

SUMMARY OF THE INVENTION

The invention relates to a rescue device for use on boats to rescue a person from the water; and, in particular, concerns a sailboat having a rescue device secured thereto.

The invention comprises a rescue system for use on a sailboat, which comprises, in combination, a sailboat having a deck with a mast thereon, preferably the mainmast, and at least one outer, generally vertically extending side shroud secured to a fitting on the deck. The device comprises an elongated tube means, typically a strong metal tube having a one lower and other upper end and vertically fitted over the said shroud on one or both sides of the sailboat, and bushing means, usually upper, intermediate and lower bushings, within the tube means to hold the tube means away from the shroud and to permit the tube means to rotate about the shroud. The device includes a crane arm having an inboard and an outboard end, and secured at the inboard end to the tube means for pivotable movement between a non-use position generally parallel to the tube means and a use position extending at a selected angle outwardly from the tube means. The device includes a control line means having a one end secured to the outboard end of the crane arm and adapted to be adjusted in use to move the crane arm between non-use and use positions. The control line is secured to the top of the tube means, is threaded through an opening at the outboard end of the crane arm and through the inside of the crane arm, emerging at the other end and secured to a cleat on the tube means, the cleat located intermediate the top and bottom of the upper tube means. The crane arm includes block and tackle means at the outboard end of the crane arm. The device includes a rescue means secured to the other end of the block and tackle means to provide for the securing of the object or person to be rescued from the water. The device further includes a means such as a winch on the sailboat and communicating with the block and tackle means to provide for the movement of the rescue means when the crane arm is rotated to a position over the side of the sailboat in a use position. The block and tackle means hoists the rescue means between a lower rescue position and an upper position whereby the person or object in the rescue means in the upper position may then be swung over the deck and lowered to the deck.

The tube means comprises a first lower tube means and a second upper tube means, with the first lower tube means having a greater diameter than the second upper tube means in order to fit over the shroud, turnbuckle and fitting adjacent the deck. Optionally, the device has an elongated support means secured at one end to the mast and pivotable to and at the other end secured pivotably to the metal collar at the upper end of the tube means. Generally, the winch means, already existing independently of the rescue device, is secured to the mast of the sailboat. The bushing means may include a lower bushing mounted at the one lower end of the tube means, about the fitting on the deck, an upper bushing mounted at the other upper end of the tube means, and a third bushing means intermediate the upper and lower bushings where the upper tube is inserted into the lower tube. These bushings protect the shroud from wear and damage in use and provide for the rotation of the tube means about the shroud. The intermediate bushing further provides for added resistance to force applied by the crane arm to the point where the upper tube and lower tube intersect.

The invention provides a device for retrieving from the water a person who has fallen overboard from a sailboat. The device consists of a crane, which is mounted on the upper/outer stay (shroud) of the mainmast of the boat. The mounting mechanism for the crane comprises: 1) a strong, cylindrically-shaped metal tubing, which is vertically fitted over the outer shroud. Stainless steel tubing with a ⅛" wall is recommended from among currently available materials, though the material and its specifications need not be restricted to this choice; and 2) cylindrically-shaped bushings. The bushings may be made from a strong, low-friction material such as a plastic material, like nylon acetyl, resin or the like. The bushings are inserted inside the vertical tubing at deck level, and at positions higher up on the tubing. The bushings are shaped to fit snugly within the inner diameter of the tubing, but not to fit so tightly as to bind. The center of the bushings is bored out to a diameter slightly larger than that of the outer shroud itself. By this means, the shroud is held away from the tubing. Also by means of the bushings, the tubing is enabled easily to rotate around the shroud. The shroud or cable, with its great strength, vertical orientation, and high mounting tension, serves as the axis of rotation. The shroud is protected from wear by the softer material of the bushings, and by the lower friction property of the bushing material. The bushing at the base of the tubing protects the deck of the sailboat from scratches, gouges and other damage, and also enables the tubing to rotate as needed. The inner diameter of the tubing is large enough to clear the width of the turnbuckle and its deck-mounted fitting.

The crane consists of an arm, mounted via a jaw affixed to the vertical tubing at a height sufficient to clear the lifelines of the boat, an eye on the inboard end of the arm, and a non-release pin or, alternatively, a nut-and-bolt device, either of which is used to secure the crane arm to the vertical tubing. The crane arm is made of stainless steel cylindrical tubing, or equivalently strong material. The diameter of the arm tubing can be smaller than that of the vertical tubing mounted on the shroud, though the arm tubing must be of sufficient strength to withstand with adequate margin of safety the compression and lateral bending forces to which it is subjected.

The inboard and outboard ends of the arm each contain pulleys aligned longitudinally with the arm. Through the arm is run a control line of adequate strength and essentially no-stretch property. The line, which controls the angular position of the crane arm, is permanently attached to a ring that it itself affixed to the upper end of the vertical tubing. The control line emerges from the lower, inboard end of the crane arm, hence running upwards over the pulley affixed at this inboard end to a cleat that is affixed to the shroud tubing. By this means, with the control arm maximally shortened, the arm can be held in a retracted vertical position when the crane is not in use, tied against the larger, shroud-mounted vertical tubing. When the crane is to be used, the arm is lowered to a suitable angle by means of the control line, which is then cleated. For quicker and more efficient action in emergency conditions, the optimum working angle for the crane arm can be predetermined and the corresponding spot on the control line marked or even knotted into a loop, for cleating.

Mounted on the outboard end of the crane arm is a block and tackle with a snapshackle on the lower block. When the crane is put into use, the snapshackle is attached to a device that will hold the overboard person for the purpose of lifting the person aboard. When the block and tackle is lowered toward the water, the overboard victim can engage the holding device, and then be hoisted aboard the boat.

The block and tackle may be arranged two different ways. One way uses a multi-part tackle of adequate mechanical advantage, using a spring-loaded automatic cam cleat on the upper end to prevent the line, under load, from slipping outward. This arrangement would allow the onboard rescuer to pull the line in by hand to the point where the overboard person is raised to deck level. The rescuer can then grasp the crane arm and direct it aft, by this means rotating the crane rearward and bringing the crane arm inboard of the vessel. The victim can then be lowered to the deck.

Another way alternatively uses a block and tackle of fewer line parts and can run the inboard end of its line through a pulley affixed to the collar that encapsulates the upper end of the vertical tubing. That tubing, as already described, is itself mounted over the shroud; the tubing turns freely within the encapsulating collar. From this pulley, the line can be further run to a pulley mounted at proper height on the mainmast, after which the line can be run downwards to one of the large halyard winches mounted on the mast. The combined mechanical advantage of the block and tackle and the halyard winch reduce to easily-managed levels the force required to lift the overboard person from the water.

The collar at the upper end of the shroud-mounted tubing contains a ring that is oriented inboard. To this ring optionally can be attached either non-stretch line, cable or tubing of moderate diameter and properly fitted length to act as a further support means. This line or tubing would be run perpendicular to the mast, where it is attached to a bracket specially mounted on the mast. In this way, the vertical shroud-mounted tubing is braced against the outboard pull it will sustain from the weight of the overboard person as he is hoisted from the sea. As a consequence, the shroud itself is prevented from being pulled out of its proper vertical alignment. The support brace is an option, for use if the tension with which the shroud is mounted is insufficient to prevent tubing misalignment. In like manner, a forward-oriented ring, affixed to the collar at the upper end of the shroud-mounted tubing, allows an additional length of non-stretch line to be run to a forward attachment point, thereby bracing the crane against rearward pull when the crane rotates aft to deposit the person rescued from overboard on the boat's deck. The individual boat owner can determine the proper forward attachment point for this second brace, if it is in fact needed.

The invention will be described for the purposes of illustration only in connection with certain embodiments; however, it is recognized that various modifications, changes, additions and improvements may be made by those persons skilled in the art without departing from the spirit and scope of the invention.

DESCRIPTION OF THE EMBODIMENTS

Figure 1:
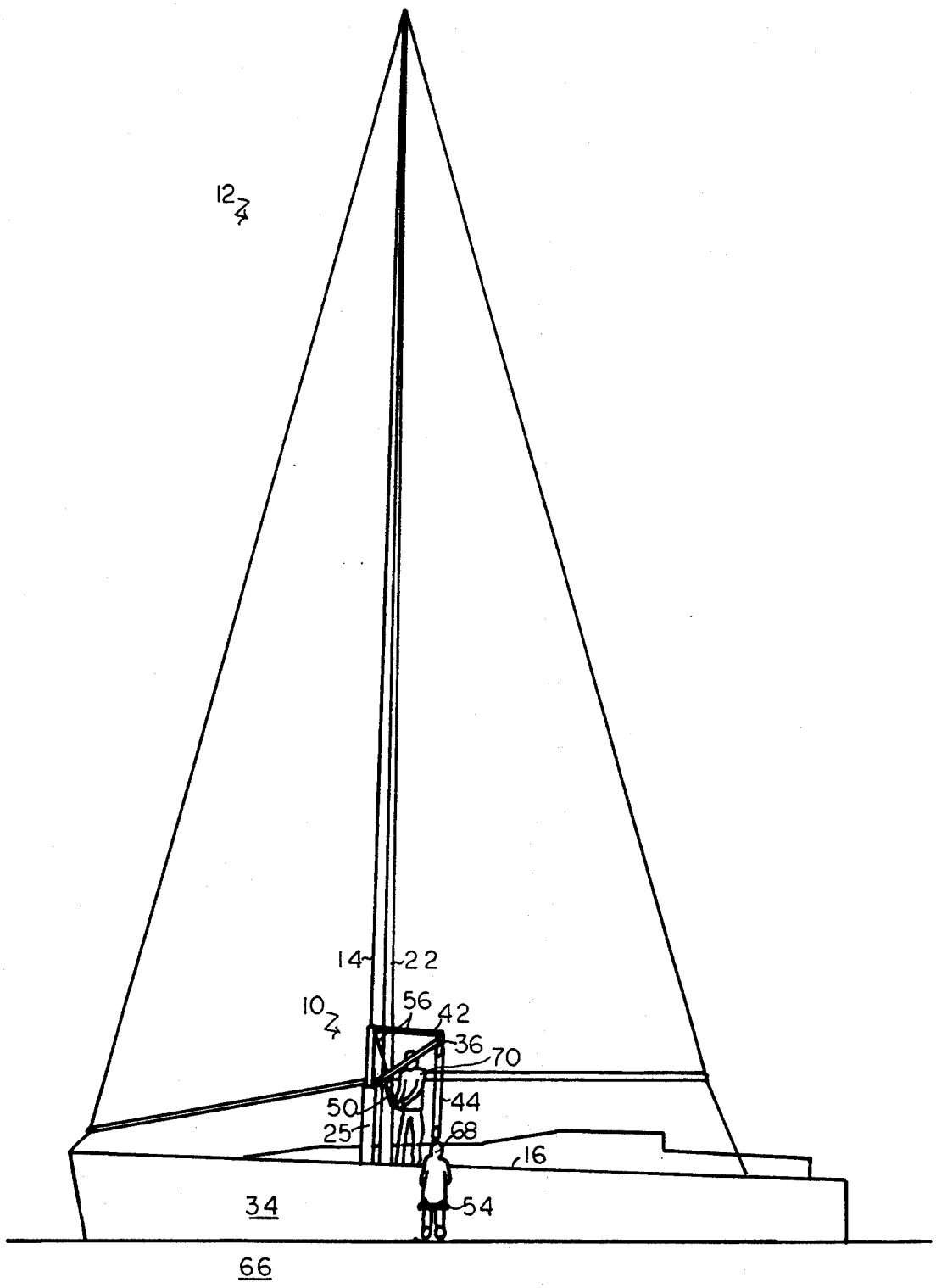
FIG. 1 is a schematic perspective view of a sailboat with the rescue device in use.

FIG. 1 shows a schematic perspective view of a sailboat 12 in the water 66 with the rescue device of the invention 10 in use with a person 68, who has fallen overboard, being rescued. The person 68 is sitting on the T-bar rescue means 54 and is being lifted onto the deck 16 of the sailboat 12 by a rescuer 70. The rescuer 70 is turning the winch 50 attached to the mast 22. By turning the winch 50 and shortening the rope 56, the rescuer 70 employs the block and tackle means 44 at the outboard end of the crane arm 36 to hoist the person 68 out of the water 66. The crane arm 36 is connected to a tube means 25 surrounding the shroud 14 extending vertically from the side of the sailboat 12. The shroud 14 is connected to the deck 16 by means of a deck fitting 20 (seen in FIG. 2).

Figure 2:
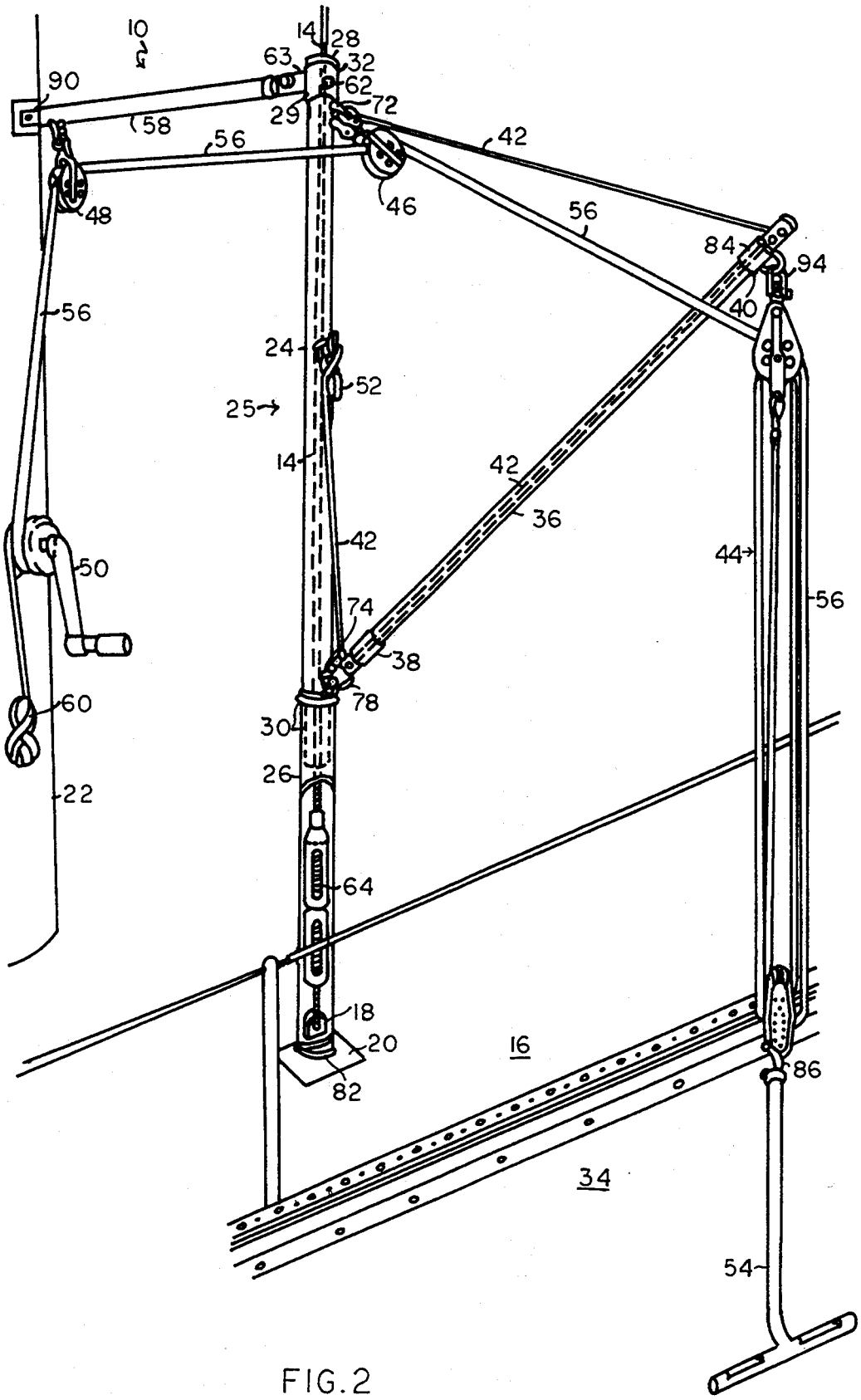
FIG. 2 is an enlarged, fragmentary perspective view of the sailboat of FIG. 1 prior to rescue use.

FIG. 2 shows in further detail the invention of FIG. 1, with the sailboat 12 having a deck 16 with a deck fitting 20 with an eye 18 to secure the shroud 14 to the deck 16. The tube means 25, which comprises an upper 24 and lower 26 tube means, is placed over the shroud 14. The upper tube means 24 has a smaller diameter than the lower tube means 26, so that the upper tube means 24 fits within the lower tube means 26 in use. The upper tube means 24 has a bushing 28 thereon, the bushing 28 having a center hole 32 of a diameter to fit around the shroud 14, to protect the shroud 14 from the sides of the tube 24, while allowing for the rotation of the shroud 14 within the tube means 25. The upper tube 24 also has a metal collar 29 at the top portion, directly below the bushing 28, to retain the position of the tube means 25. The metal collar 29 has an inboard securing means 63 and front ring securing means 62 integrally extending therefrom. The inboard securing means 63 is provided for the secure attachment of the optional support arm 58. This support arm can either be comprised of metal or rope, but in this embodiment is shown as a metal support arm 58. The metal support arm 58 is secured to the mast 22 by a pivotable securing means 90. The front ring securing means 62, located at a ninety degree angle forward of the inboard securing means 63, provides for a forward securing means if such additional securing is desired by the boat owner for added vertical stability of the rescue device.

The upper tube 24 has an upper ring 72 and a lower jaw 74 means, with a cleat 52 intermediate therebetween. The lower jaw 74 provides for the attachment of the crane arm 36 at the crane arm's inboard end 38, and the upper ring 72 provides for attachment of the crane arm control line 42 and the pulley 46 for the hoisting rope 56. The crane arm control line 42 is secured to the upper ring 72 and extends to the outboard end of the crane arm 40, into a small metal collar with pulley 76 and through the inside of the crane arm 36, where it emerges at the inboard end 38, is threaded through a small pulley 78, which pulley 78 is secured to the jaw 74 at the lower end of the upper tube 24. The control line 42 is then secured to the intermediate cleat 52, providing for a selected angle of the crane arm 36 in use as required by the rescuer 70.

A second intermediate bushing means 30 is inserted into the larger diameter lower tube means 26, which bushing means extends a distance into the cavity (shown in dotted lines) inside the lower tube to further strengthen the tube means 25 at its point of greatest stress, where the upper 24 and lower 26 tubes and the crane arm 36 intersect. The securing means 78 on the inboard end 38 of the crane arm 36 that is secured to the lower portion of the upper tube means 24 is affixed to the upper tube 24.

A third bushing 82 is fitted around the lower end of the lower tube means 26 to protect the deck 16 of the sailboat 12 against gouges from the tubing means 25 in use. The third bushing 82 is of adequate diameter to fit around the shroud turnbuckle 64 and the clamp 18.

The outboard end 40 of the crane arm 36 has a block and tackle 44 attached thereon by means of a shackle 94 secured to the outboard end ring securing means 84. The hoisting rope 56, with the block and tackle means 44, provides a hoisting mechanism. At the lower end of the block and tackle means, a rescue means in the shape of a T-bar 54 is securely attached by means of a snap-shackle 86 to provide a means for a person 68 in the water to sit on to be lifted out of the water 66. The hoisting rope 56 is operated by means of the block and tackle 44 at one end, and at the other end by a winch means 50 that is secured to the mast 22 of the sailboat 12. The rope 56 extends through the upper block of the block and tackle 44, through a first pulley means 46 attached to the upper end of the upper tube means 24, through a second pulley means 48 attached to the support arm 58, and down to the winch 50. The rope 56 is secured by a cleat 60, which cleat is attached to the mast 22 at a point below the winch 50. Inside the lower tube means 26 a turnbuckle 64 is shown attached to the shroud 14 and an eye 18 which is part of the deck fitting 20, which allows for the tensioning of the shroud 14 as needed.

Figure 3:
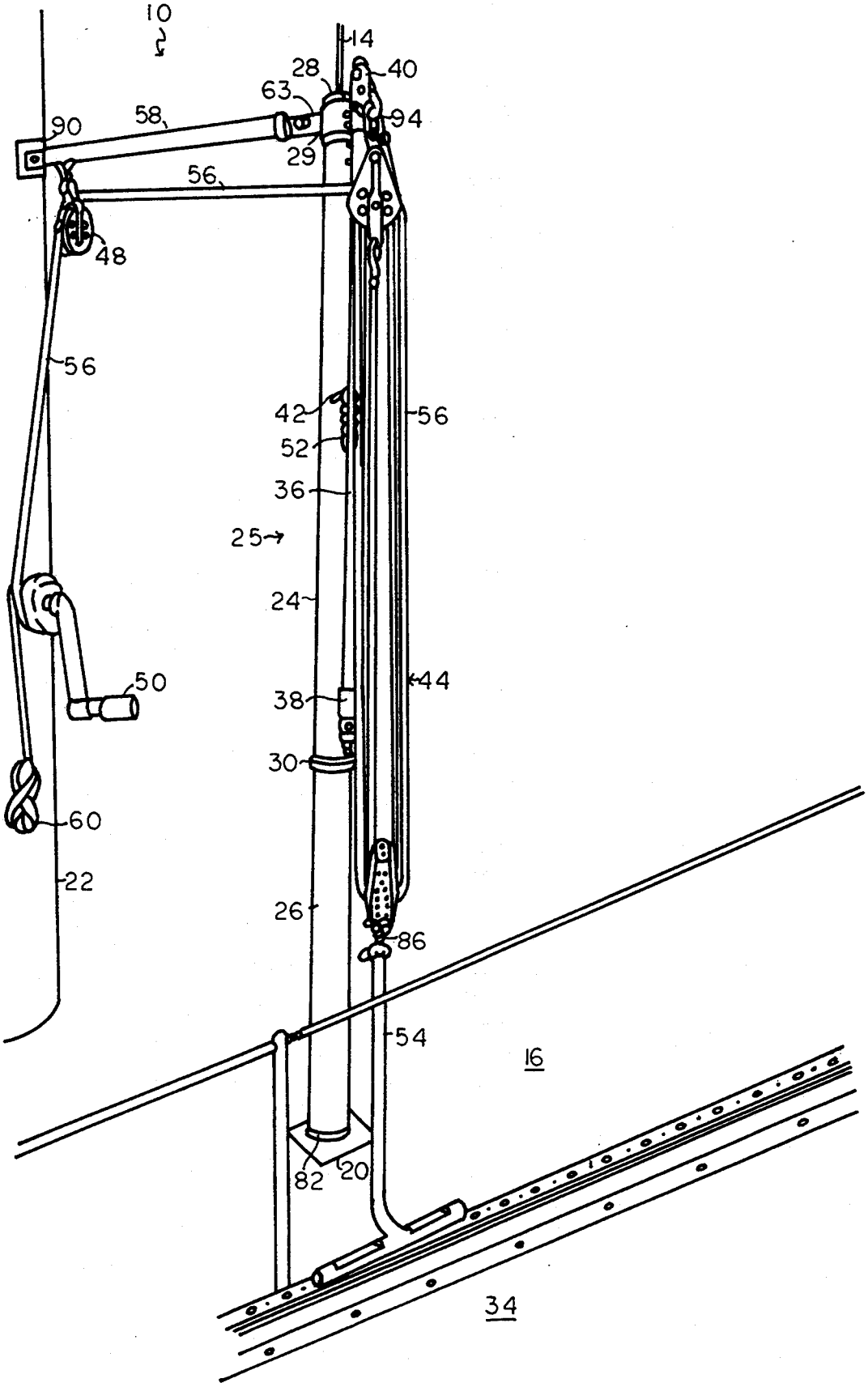
FIG. 3 is an enlarged perspective view of the rescue device in a stored, non-use position.

FIG. 3 shows the rescue device 10 in the non-use position, with the crane arm 36 in a retracted position against the tube means 25. The crane arm 36 is retracted by means of the control line 42 being pulled in and secured at the cleat 52. The T-bar rescue means 54 is also shown in the retracted position for easy access and use by a rescuer in an emergency situation.

Figure 4A:
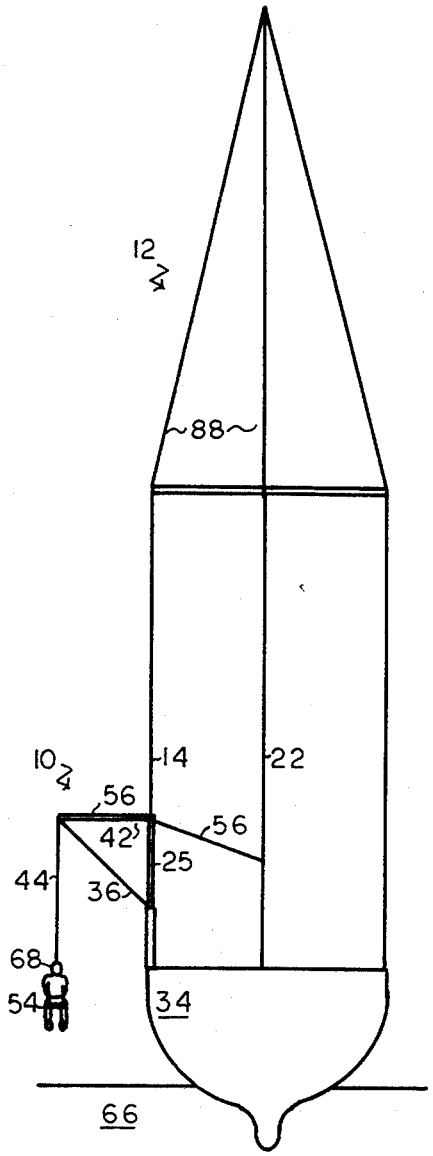
FIG. 4A and 4B are representative views of the rescue device at various use angles.
Figure 4B:
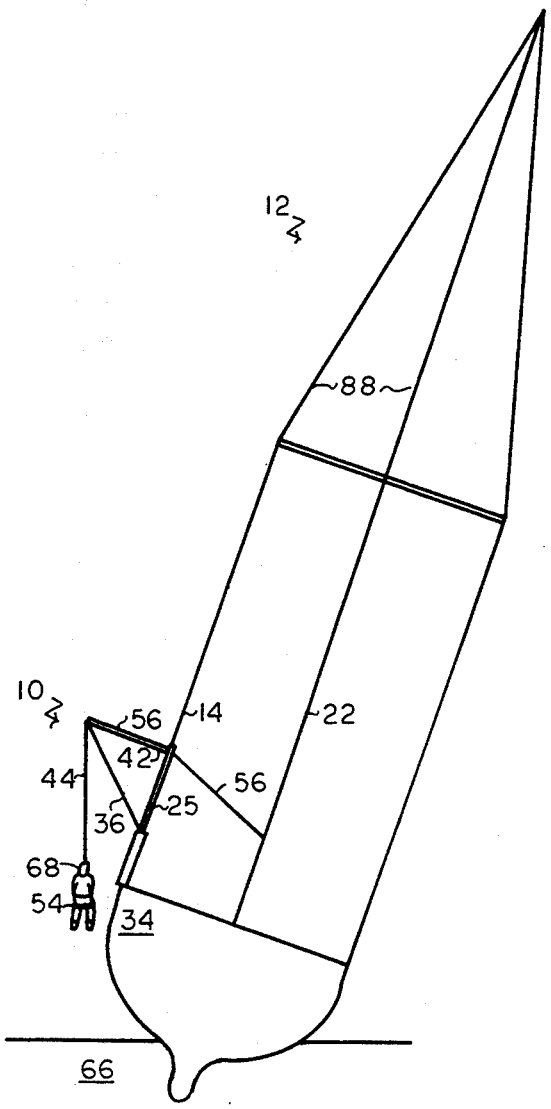

FIGS. 4A and 4B show a schematic view of the invention of FIG. 1 in use on a sailboat in moving seas. The sailboat 12 is rolling in response to wave action, and the device 10 is shown with the tube means 25 attached to the shroud 14 extending from the mast rigging 88. The control line 42 and hoisting rope 56 are shown, the crane arm 36 extended and having the block and tackle 44 with the rescue means 54 extending therefrom. The hoisting rope 56 is shown secured to the mast 22. FIG. 4A shows the rescue device 10 with the boat 12 in an upright position, having the person 68 being rescued also in an upright position away from the hull 34 of the sailboat. FIG. 4B shows the device 10 in use in rough water 66, with the sailboat 12 at an angle due to wave action, and the rescue device 10 of the invention in an offset position so that the person 68 in the rescue means 10 is maintained in an upright position and away from the hull 34 of the sailboat, instead of smashing against the hull.

In operation, the rescue device of the invention 10 is installed on a sailboat 12 by threading the shroud 14 through the center hole 32 in the upper bushing 28, the upper tube means 24 that is placed within the intermediate bushing 30 and lower tube means 26, the lower bushing 82, the shroud 14 secured to the deck by means of an eye 18 to a deck fitting 20. The shroud 14, which is part of the main rigging 88 connected to the mast 22 at one end and the deck 16 at the other end, serves as the rotational axis for the rescue device 10. The secure orientation of the shroud 14 further provides tension and support for the rescue device 10 in use. The upper bushing 28 of the upper tube means 24 has a small diameter center hole 32 to protect the shroud 14 against wear by contact with the sides of the tube means. The rescue device has a metal collar means 29 around the top portion of the upper tube means 24 with ring 62 and inboard securing means 63 thereon to provide for further support of the device in use by securing metal or rope support arms to the tube means and securing them to other portions of the rigging or sailboat. Optionally and preferably, one support arm 58 extends from a securing means 63 at the inboard side of the metal collar 29 and is secured to the mast 22 with a fitting 90.

The tube means 25 has a crane arm 36 extending therefrom, attached in an angularly movable manner to a withdrawn, non-use position against the tube means 25 and a use position at an angle from the tube means 25. The crane arm 36 has a control line 42 extending from the top portion of the upper tube means 24 through the pulley-mounted outboard end 40 of the crane arm, through the inside of the crane arm 36 and emerging at the inboard end 38, threading through a small pulley 78 and secured at the other end by means of a cleat 52. In use, the crane arm 36 is extended as needed in relation to the specific rescue operation, but it is also possible to predetermine the desired angle and mark the control line 42 or tying a loop therein for faster operation.

A block and tackle 44 means with a T-bar rescue means 54 is secured to the crane arm 36, with the hoisting rope 56 from the block and tackle means 44 extending through the block and tackle 44, a pulley 46 on the upper portion of the upper tube means 24, and a pulley 48 on the support arm 58 to a winch 50 secured to the mast 22. While the block and tackle 44 allows easier hoisting by the rescuer 70 of the person 68 on the rescue device 10, by the rescuer merely pulling the rope into the sailboat, the winch 50 provides further mechanical advantage, hence ease for a rescuer in lifting the person on board. More particularly, the invention provides for easier hoisting of a person who may weigh more than the rescuer, due to the victim's body size or the weight of water-saturated clothing.

In a typical rescue operation, after the "man overboard" alert, the sailboat is brought around approximate to the person in the water. The ability of the rescue device to rotate on its shroud axis provides for flexibility of the rescue device as needed, relative to the person's position in the water. At this point, the T-bar rescue means would be lowered to the person in the water, who would then either sit or otherwise secure him/herself to the T-bar. The rescuer on deck would then pull in the hoisting rope, optionally using the winch, to hoist the person onto the deck. The extended crane arm insures that the person being rescued will not be smashed against the hull of the sailboat if the boat rolls due to wave action, thus preventing injury to the person being rescued.

This rescue device can also be used with other retrieval means on the end of the block and tackle for other types of retrieval operations, but preferably is used for the rescue of a person in the water.

As shown and described, the rescue device of the invention provides for a stable and flexible means for the rescue of a person overboard, an easier means of lifting the person in the water when the rescuer may be of a smaller size or less weight, and a safer means of retrieval for the person in the water, removing the danger of injury by smashing into the hull of the sailboat while being hoisted onto the deck.

What is claimed is:

1. A rescue system for use on a sailboat which comprises in combination:

a) a sailboat having a deck with a mast thereon and an outer, generally vertically extending side shroud secured to a fitting on the deck;

b) a rescue system which comprises:

i) an elongated tube means having a one lower and other upper end and fitted over the said shroud;

ii) bushing means within the tube means to hold the tube means away from the shroud and to permit the tube means to rotate about the shroud;

iii) a crane arm having an inboard and an outboard end, and secured at the inboard end to the tube means for pivotable movement between a non-use inboard position generally parallel to the tube means and a use outboard position extending angularly outwardly from the tube means;

iv) control line means having one end secured to the outboard end of the crane arm to move the crane arm between a non-use and a use position;

v) block and tackle means secured at the outboard end of the crane arm and having an other end;

vi) rescue means secured to the other end of the block and tackle means to provide for the securing of the object or person to be rescued; and vii) hoist means on the sailboat and communicating with the block and tackle means to move the rescue means, when the crane arm is rotated over the side of the sailboat in a use position, between a lower rescue position and an upper rescue position whereby the person or object in the rescue means in the upper position may then be swung over the deck and be lowered to the deck.

2. The system of claim 1 wherein the rescue means comprises an inverted T-bar.

3. The system of claim 1 wherein the block and tackle means includes an upper block at outboard end of the crane arm and a lower block means adjacent to and secured to the rescue means.

4. The system of claim 1 wherein the tube means comprises a first lower tube means and a second upper tube means.

5. The system of claim 4 wherein the first lower tube means has a greater diameter than the second upper tube means.

6. The system of claim 4 which includes a bushing means mounted at the top of the first lower tube means and having the second upper tube means inserted therein.

7. The system of claim 1 which includes an elongated support means secured at one end to the mast and at the other end to the upper end of the tube means.

8. The system of claim 5 wherein the shroud includes a turnbuckle at the lower end and the diameter of the lower tube means is sufficient to extend over the turnbuckle.

9. The system of claim 1 wherein the hoist means comprises a winch.

10. The system of claim 1 wherein the bushing means includes a lower bushing mounted about the fitting on the deck at the one lower end of the tube means and an upper bushing mounted at the other upper end of the tube means.

11. The system of claim 1 wherein the line control means comprises a line secured to the upper end of the tube means and extends to the outboard end of the crane arm and through the crane arm and to a cleat means.

12. A rescue system for use on a sailboat which comprises in combination:

a) a sailboat having a deck with a mast and an outer, generally vertically extending side shroud secured by a turnbuckle to a fitting on the deck and extending upward from the deck; and b) a rescue system which comprises:

i) an elongated tube means comprising a first lower and a second upper tube means, the first lower tube means having a greater diameter than the second upper tube means and fitting over the turnbuckle, and the tube means having a one and other end fitted over the said shroud;

ii) an elongated support means secured at one end to the mast and at the other end to the upper other end of the tube means;

iii) upper, lower and intermediate bushing means within the tube means to hold the tube means away from the shroud and to permit the tube means to rotate about the shroud;

iv) a crane arm having an inboard and an outboard end, and secured at the inboard end for pivotable movement between a non-use position generally parallel to the tube means and a use position extending angularly outwardly from the tube means;

v) control line means secured to the outboard end and adapted on use to move adjustably the crane arm between a non-use and a selected use position;

vi) block and tackle means at the outboard end of the crane arm and having a one and other end;

vii) rescue means at the other end of the block and tackle means to provide for the securing of the object or person to be rescued; and viii) winch means on the sailboat communicating with the block and tackle means to move the rescue means, when the crane arm is rotated, to a position over the side of the sailboat in a use position between a lower rescue position and an upper rescue position, whereby the person in the rescue means in the upper position may then swing over the deck and be lowered to the deck.

13. The system of claim 12 wherein the rescue means comprises an inverted T-bar.

* * * * *